US011560765B2

(12) United States Patent
Watkins et al.

(10) Patent No.: US 11,560,765 B2
(45) Date of Patent: Jan. 24, 2023

(54) DOWNHOLE CIRCULAR CUTTING TORCH

(71) Applicant: CHAMMAS PLASMA CUTTERS LLC, Houston, TX (US)

(72) Inventors: Todd Joseph Watkins, Houston, TX (US); Jian Zhang, Jersey Village, TX (US)

(73) Assignee: CHAMMAS PLASMA CUTTERS LLC, Houston, TX (US)

( * ) Notice: Subject to any disclaimer, the term of this patent is extended or adjusted under 35 U.S.C. 154(b) by 0 days.

(21) Appl. No.: 17/341,923

(22) Filed: Jun. 8, 2021

(65) Prior Publication Data

US 2022/0034183 A1 Feb. 3, 2022

Related U.S. Application Data

(60) Provisional application No. 63/057,596, filed on Jul. 28, 2020.

(51) Int. Cl.
*E21B 29/02* (2006.01)

(52) U.S. Cl.
CPC ..... *E21B 29/02* (2013.01)

(58) Field of Classification Search
CPC .... E21B 29/02; E21B 31/002; E21B 23/0414; E21B 23/0417; E21B 31/16
See application file for complete search history.

(56) References Cited

U.S. PATENT DOCUMENTS

| | | | | |
|---|---|---|---|---|
| 3,695,951 | A | 10/1972 | Helms et al. | |
| 4,298,063 | A | 11/1981 | Regalbuto et al. | |
| 5,435,394 | A * | 7/1995 | Robertson | E21B 29/02 166/382 |
| 6,598,679 | B2 | 7/2003 | Robertson | |
| 6,925,937 | B2 * | 8/2005 | Robertson | E21B 29/02 102/202 |
| 7,632,365 | B1 | 12/2009 | D'Arche et al. | |
| 7,690,428 | B2 | 4/2010 | Robertson | |
| 7,900,704 | B2 | 3/2011 | Robertson | |
| 8,020,619 | B1 * | 9/2011 | Robertson | E21B 29/04 166/54.5 |
| 8,196,515 | B2 | 6/2012 | Streibich et al. | |
| 8,474,381 | B2 | 7/2013 | Streibich et al. | |
| 10,787,864 | B1 | 9/2020 | Robertson et al. | |
| 2003/0051870 | A1 * | 3/2003 | Robertson | E21B 29/02 166/55.7 |
| 2008/0296021 | A1 * | 12/2008 | Robertson | E21B 29/02 166/298 |
| 2016/0060988 | A1 * | 3/2016 | Tallini | E21B 29/02 83/639.4 |
| 2017/0335646 | A1 * | 11/2017 | Huang | E21B 29/02 |
| 2019/0128083 | A1 * | 5/2019 | Tallini | F42D 3/04 |

FOREIGN PATENT DOCUMENTS

WO 2016007182 A1 1/2016

* cited by examiner

*Primary Examiner* — David Carroll
(74) *Attorney, Agent, or Firm* — Ewing & Jones, PLLC

(57) ABSTRACT

A circular cutting torch includes a thermal igniter assembly; a compressed grain magazine, the compressed grain magazine coupled to the thermal igniter; and a severing head assembly. The severing head assembly includes a one-piece severing head and a progressive compression deflector. The one-piece severing head and progressive compression deflector define a radial gap therebetween used to expel a jet of molten combustible material for cutting a downhole tubular member such as pipe or casing.

26 Claims, 13 Drawing Sheets

DOWNHOLE CIRCULAR CUTTING TORCH

CROSS-REFERENCE TO RELATED APPLICATIONS

This application is a non-provisional application which claims priority from U.S. provisional application No. 63/057,596, filed Jul. 28, 2020, which is hereby incorporated by reference in its entirety.

TECHNICAL FIELD/FIELD OF THE DISCLOSURE

The present disclosure relates generally to downhole tools, and specifically to downhole cutting tools.

BACKGROUND OF THE DISCLOSURE

When drilling a subterranean wellbore for the purpose of obtaining petroleum, natural gas, water, and other underground resources, it is sometimes necessary to cut and retrieve pipe or casing during drilling operations or when unwanted circumstances occur during well completion operations. Cutting and retrieving pipe and casing may be performed in maintenance and well abandonment operations. When removing the cut section of pipe to be retrieved from the wellbore, it may be desirable to have a clean cut that leaves the outer diameter and inner diameter of the pipe approximately the same as the original condition, simplifying pipe retrieval operations.

Typical pipe cutting devices may use explosive shaped charges to sever the pipe. However, these devices may swell, crack, or otherwise deform the pipe. Explosive cutters may also leave debris in the wellbore after the cut, which may cause difficulties with pipe retrieval. Thermal cutting torches had been developed to burn through the pipe, allowing for a clean cut. However, in high pressure oil and gas wells, drilling fluids known as mud, are pumped into the well, allowing for pressure control and circulation of the drill cuttings. The drilling mud may interfere with mechanical moving parts of current thermal cutting torch designs.

SUMMARY

The present disclosure provides for a circular cutting torch. The circular cutting torch may include a thermal igniter assembly. The circular cutting torch may include a compressed grain magazine, the compressed grain magazine coupled to the thermal igniter. The circular cutting torch may include a severing head assembly. The severing head assembly may include a one-piece severing head and a progressive compression deflector. The one-piece severing head and progressive compression deflector may define a radial gap therebetween.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
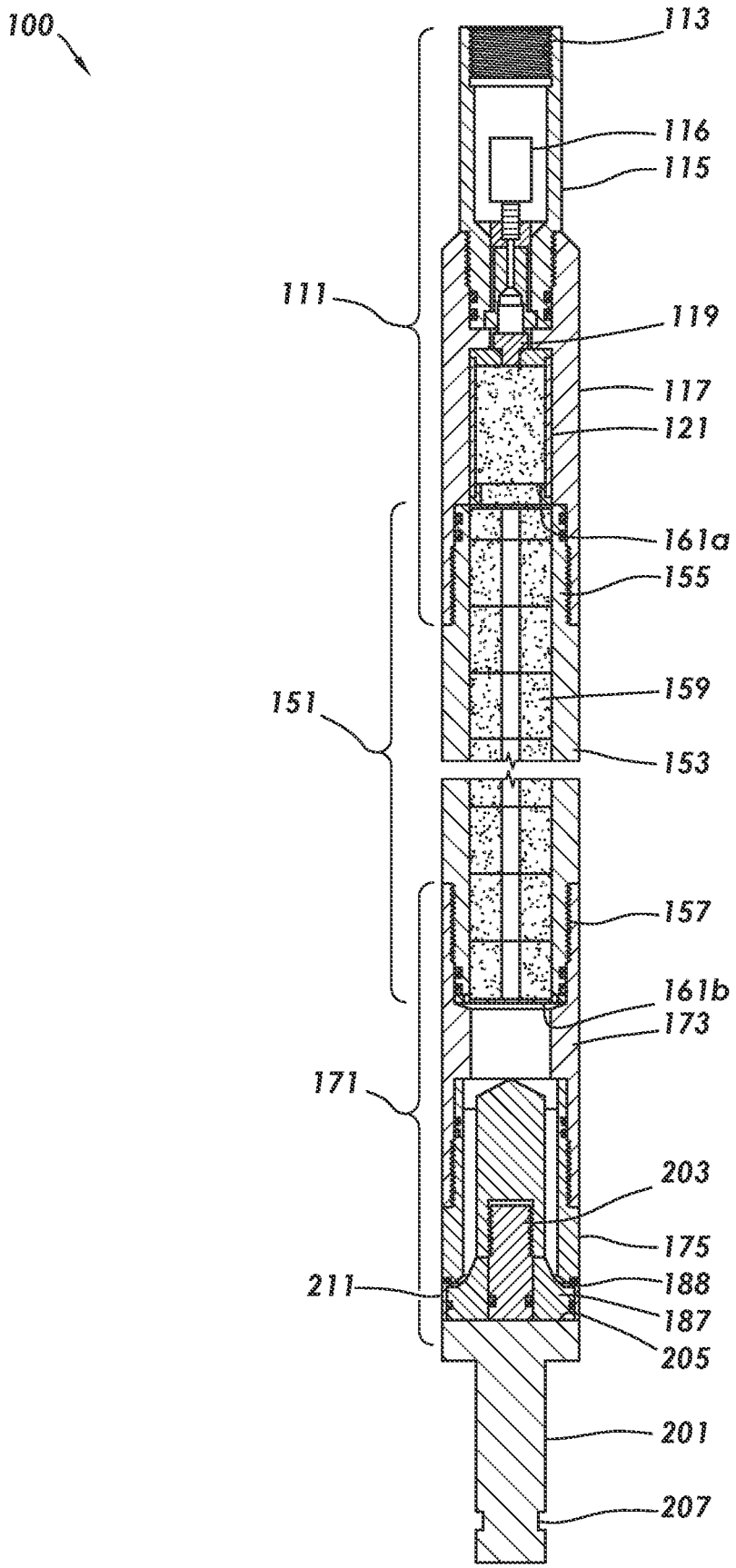
FIG. 1 depicts a cross section view of a circular cutting torch consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

For the purposes of the present disclosure, the terms "upper," "upward," and "above" refer to the relative direction as within a wellbore in a direction toward the surface regardless of the orientation of the wellbore. For the purposes of this disclosure, the terms "lower," "downward," and "below" refer to the relative direction as within a wellbore in a direction away from the surface regardless of the orientation of the wellbore.

FIG. 1 depicts a cross section view of circular cutting torch 100 consistent with at least one embodiment of the present disclosure. Circular cutting torch 100 may be positioned within a wellbore. In some embodiments, circular cutting torch 100 may be positioned in the wellbore by wireline, slickline, on a tubing string, or on a tubular string. Circular cutting torch 100 may be used to sever tubing or casing within which circular cutting torch 100 is positioned as discussed further below.

In some embodiments, circular cutting torch 100 may include thermal igniter assembly 111, compressed grain magazine 151, severing head assembly 171, and anchor base 201. In some embodiments, such as those in which thermal igniter assembly 111 is positioned at an upper end of circular cutting torch 100, thermal igniter assembly 111 may include upper coupler 113 positioned to allow circular cutting torch 100 to couple to a wireline, slickline, tubing string, or tubular string.

Figure 2:
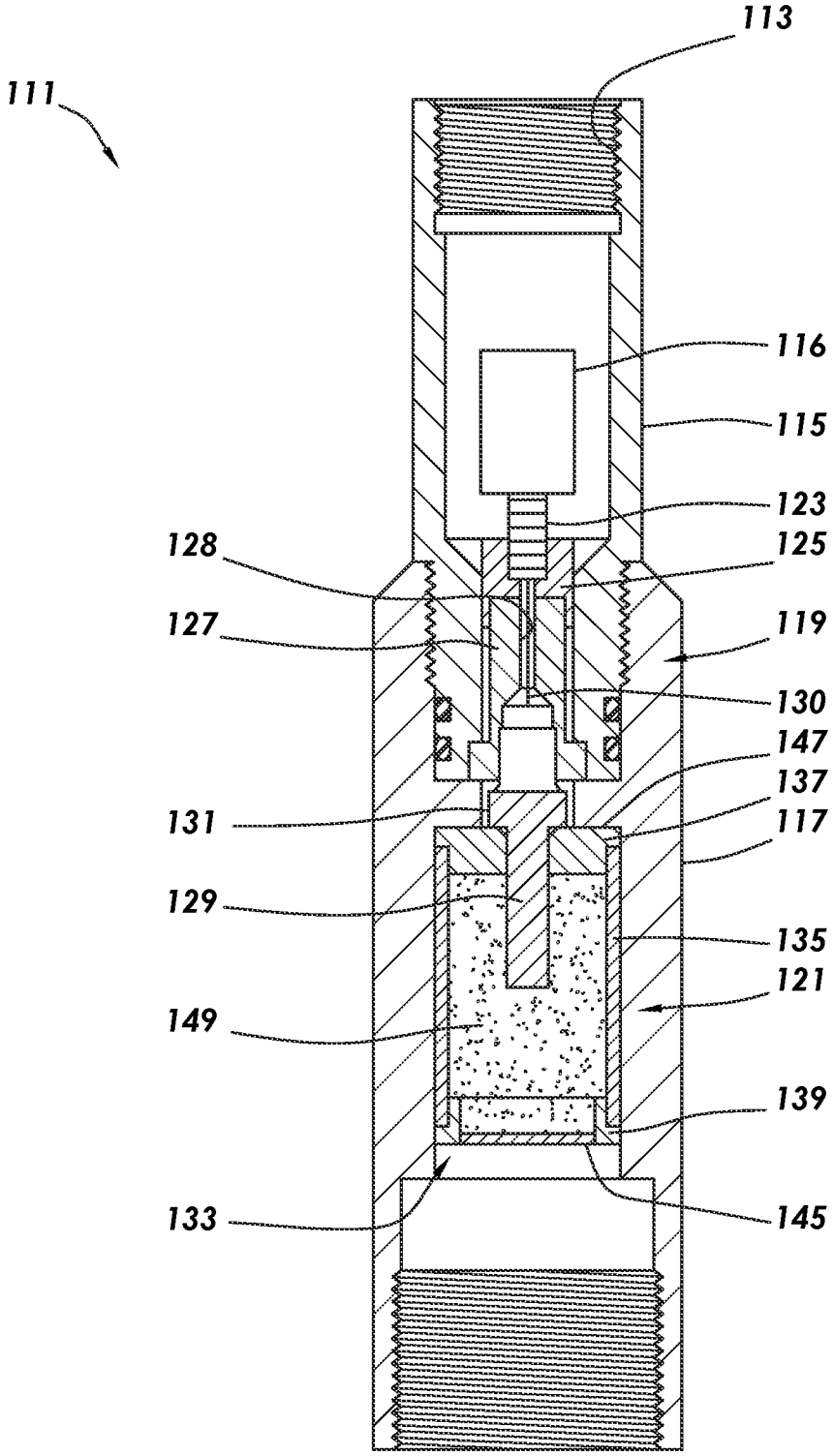
FIG. 2 depicts a cross section view of a thermal igniter and a thermal cartridge of a circular cutting torch consistent with at least one embodiment of the present disclosure.
Figure 3:
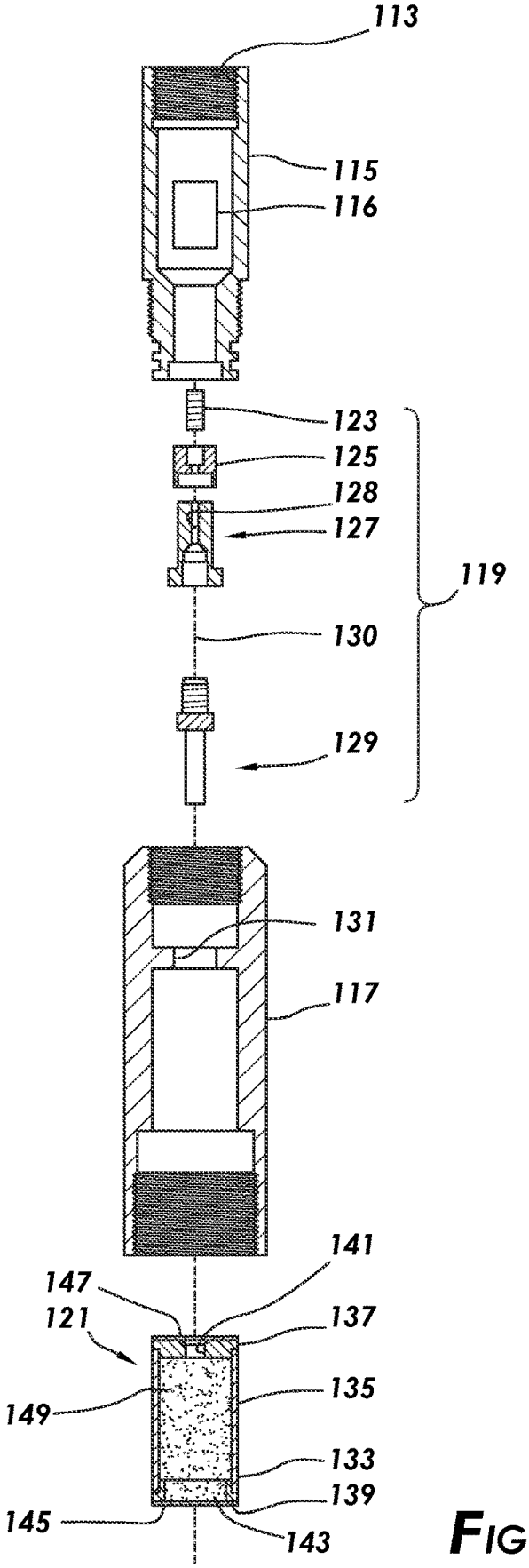
FIG. 3 depicts an exploded view of the thermal igniter of FIG. 2.
Figure 4:
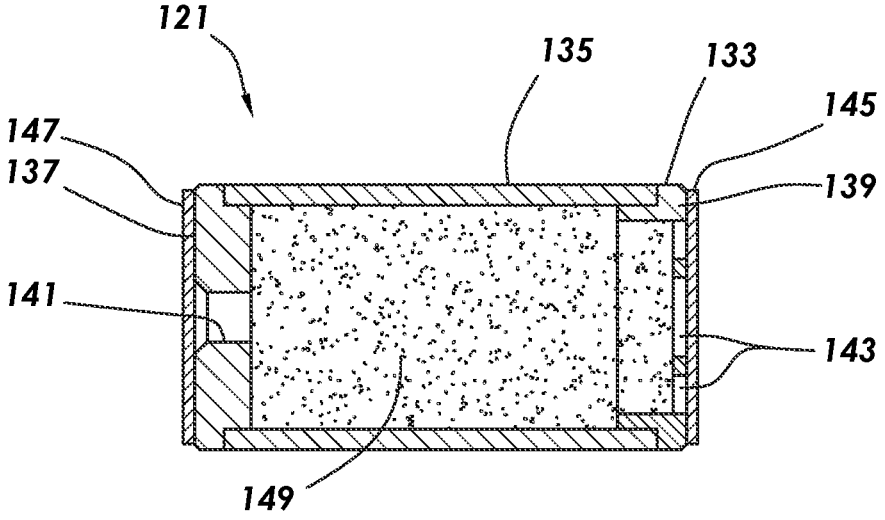
FIG. 4 depicts a cross section view of the thermal cartridge of FIG. 2.

In some embodiments, with reference to FIGS. 2-4, thermal igniter assembly 111 may include electrical sub 115, cartridge containment sub 117, thermal igniter 119, and thermal cartridge 121. Electrical sub 115 may, in some embodiments, be substantially tubular and may be used to house electronic components 116 used to power and operate circular cutting torch 100. In some embodiments, electrical sub 115 may be mechanically coupled to cartridge containment sub 117, which may itself be tubular.

In some embodiments, thermal igniter 119 may be used to initiate operation of circular cutting torch 100 as further discussed below. In some embodiments, with reference to FIG. 3, thermal igniter 119 may include spring 123. Spring 123 may be used to provide electrical contact between electronic components 116 and thermal igniter 119. Spring 123 may seat into insulation cap 125. Insulation cap 125 may be formed from a material that is electrically insulative, such that insulation cap 125 prevents electrical contact between spring 123 and cartridge containment sub 117.

In some embodiments, thermal igniter 119 may include heater stem 127. Insulation cap 125 may seat into heater stem 127. Heater stem 127 may include axial hole 128 through which conductor 130 may pass. Heater stem 127 may mechanically couple to cartridge containment sub 117. Heater stem 127 may provide sufficient seal against cartridge containment sub 117 to contain pressure experienced within circular cutting torch 100 during operation of circular cutting torch 100.

Thermal igniter 119 may include heating coil assembly 129. Heating coil assembly 129 may be mechanically coupled to heater stem 127. Heating coil assembly 129 may extend through igniter aperture 131 formed in cartridge containment sub 117. Heating coil assembly 129 may extend into the interior of thermal cartridge 121. Heating coil assembly 129 may include a heating coil adapted to, when electrically activated, provide sufficient heat to ignite thermal cartridge 121 as discussed below. In some embodiments, the heating coil of heating coil assembly 129 may be formed from tungsten wire.

Figure 4A:
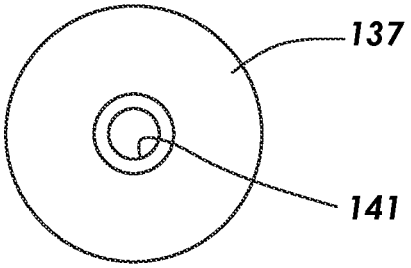
FIG. 4A depicts a top view of the thermal cartridge of FIG. 4.
Figure 4B:
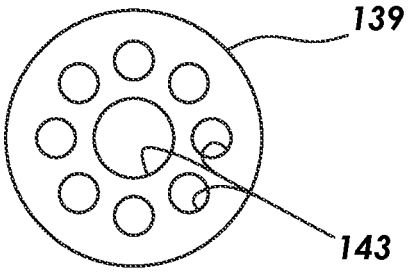
FIG. 4B depicts a bottom view of the thermal cartridge of FIG. 4.

In some embodiments, with reference to FIG. 4, thermal cartridge 121 may include cartridge housing 133. Cartridge housing 133 may be configured to fit into cartridge containment sub 117 such that heating coil assembly 129 extends at least partially into thermal cartridge 121. Cartridge housing 133 may include outer housing 135, top cap 137, and bottom cap 139. Top cap 137 may, as shown in FIG. 4A, include center hole 141 positioned to allow heating coil assembly 129 to extend through top cap 137. In some embodiments, with reference to FIG. 4B, bottom cap 139 may include one or more holes 143. In some embodiments, one or more of holes 143 may be arranged in a circular pattern through bottom cap 139. In some embodiments, referring to FIG. 4, holes 143 of bottom cap 139 may be sealed by lower seal 145, which may, for example and without limitation, be a film such as a piece of aluminum adhesive backed tape. In some embodiments, during shipping or transport or otherwise before thermal cartridge 121 is assembled to heating coil assembly 129, upper seal 147 may be affixed to top cap 137, which may, for example and without limitation, be a film such as a piece of aluminum adhesive backed tape. During assembly, heating coil assembly 129 may pierce upper seal 147 as heating coil assembly 129 enters thermal cartridge 121.

Thermal cartridge 121 may include nonexplosive combustible material 149 positioned within cartridge housing 133. In some embodiments, nonexplosive combustible material 149 may be powdered thermite. Nonexplosive combustible material 149 may be adapted to combust in response to activation and subsequent heating of heating coil assembly 129. As nonexplosive combustible material 149 combusts, molten combustible material may penetrate through seal 145 and exit thermal cartridge 121 and may be used to activate circular cutting torch 100 as discussed further below. In some embodiments, nonexplosive combustible material 149 may be in the form of loose powder.

Figure 5:
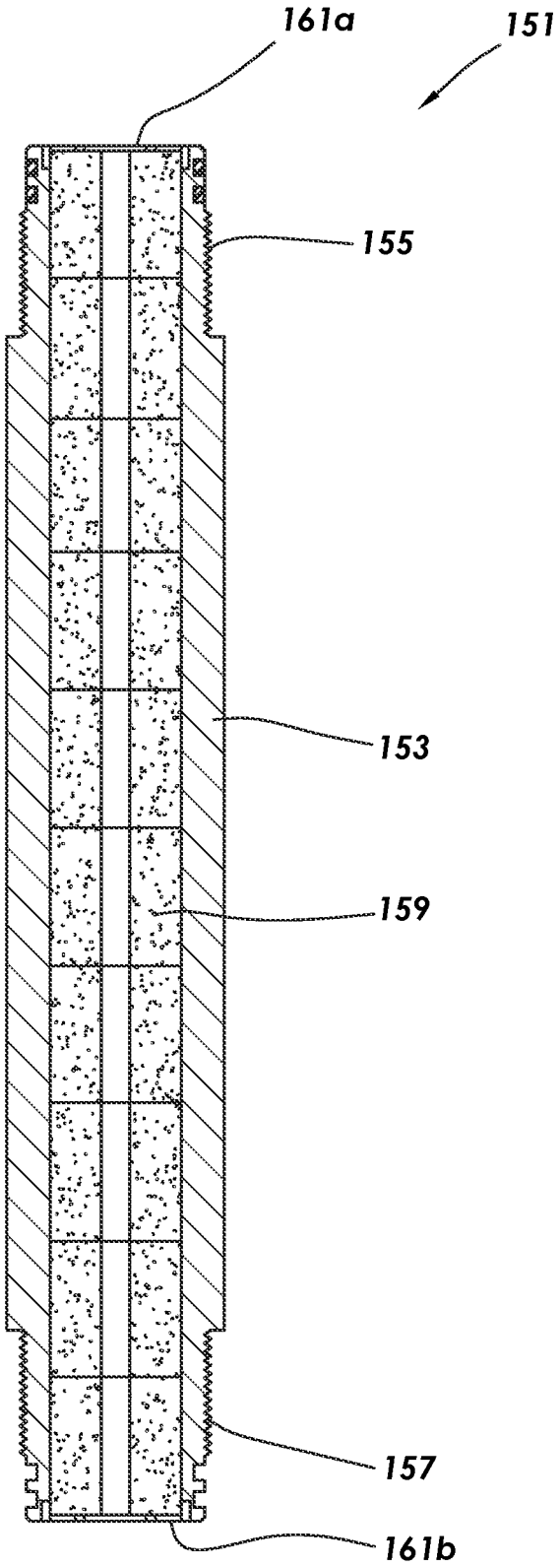
FIG. 5 depicts a cross section view of a compressed grain magazine of a circular cutting torch consistent with at least one embodiment of the present disclosure.

In some embodiments, with reference to FIG. 1, cartridge containment sub 117 may be mechanically coupled to compressed grain magazine 151. As shown in FIG. 5, compressed grain magazine 151 may include magazine housing 153, which may be tubular and may include upper coupler 155 adapted to couple to cartridge containment sub 117 and may include lower coupler 157 adapted to couple to severing head assembly 171 as further described below.

Figure 5A:
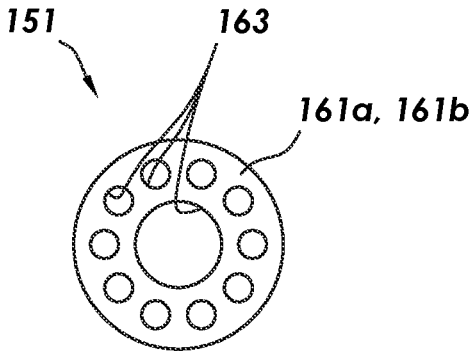
FIG. 5A depicts an end view of a compression disc consistent with at least one embodiment of the present disclosure.

In some embodiments, compressed grain magazine 151 may include compressed nonexplosive combustible material 159 positioned within magazine housing 153. In some embodiments, compressed nonexplosive combustible material 159 may be thermite. In some embodiments, compressed nonexplosive combustible material 159 may be contained within magazine housing 153 by compression discs 161*a*, 161*b* positioned on either end of magazine housing 153. In some embodiments, compression discs 161*a*, 161*b* may be press-fit into magazine housing 153. As shown in FIG. 5A, compression discs 161*a*, 161*b* may include one or more compression disc holes 163. Compression disc holes 163 may allow molten combustible material to pass through compression discs 161*a*, 161*b* during activation of circular cutting torch 100. For example, compression disc 161*a*, positioned at an upper end of compressed grain magazine 151 may allow molten combustible material from thermal cartridge 121 to pass into compressed grain magazine 151 such that compressed nonexplosive combustible material 159 may be ignited. Similarly, compression disc 161*b*, positioned at the lower end of compressed grain magazine 151, may allow molten combustible material from compressed grain magazine 151 to pass into severing head assembly 171 as further discussed below.

Figure 6:
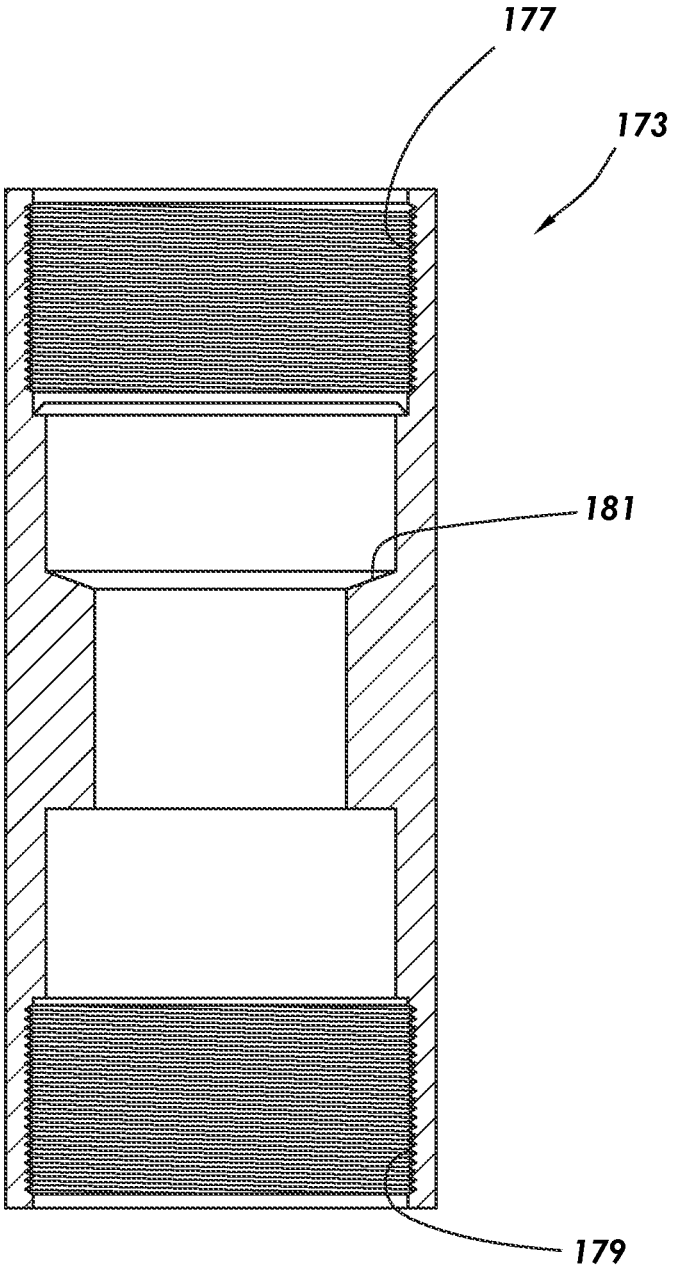
FIG. 6 depicts a cross section view of a top sub of a circular cutting torch consistent with at least one embodiment of the present disclosure.

With reference to FIG. 1, in some embodiments, severing head assembly 171 may include top sub 173, one-piece severing head 175, and progressive compression deflector 187. Top sub 173 may be tubular and may mechanically couple compressed grain magazine 151 and one-piece severing head 175. As shown in FIG. 6, top sub 173 may include upper coupler 177 positioned to couple to compressed grain magazine 151 and lower coupler 179 positioned to couple to one-piece severing head 175. In some embodiments, top sub 173 may include grain stop 181 formed on an inner surface of top sub 173. Grain stop 181 may, for example and without limitation, serve to space compressed grain magazine 151 and compressed nonexplosive combustible material 159 from one-piece severing head 175 and components thereof.

Figure 7A:
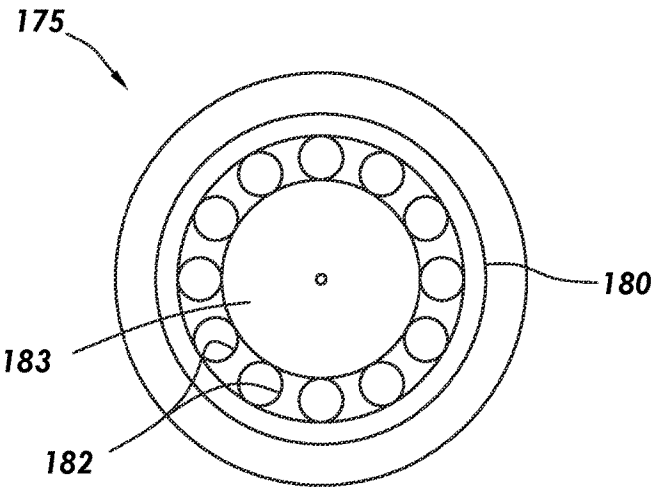
FIG. 7A depicts a top view of the severing head of FIG. 7.
Figure 7B:
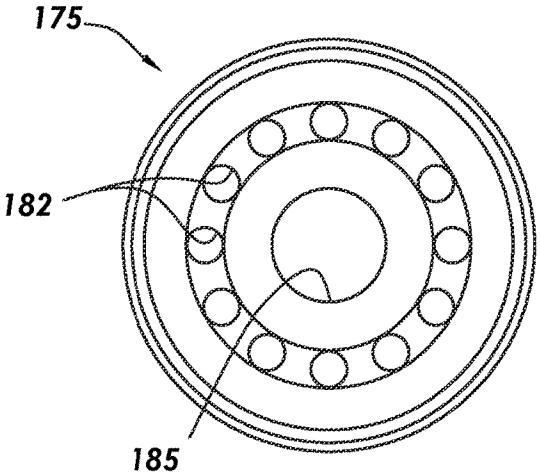
FIG. 7B depicts a bottom view of the severing head of FIG. 7.
Figure 7:
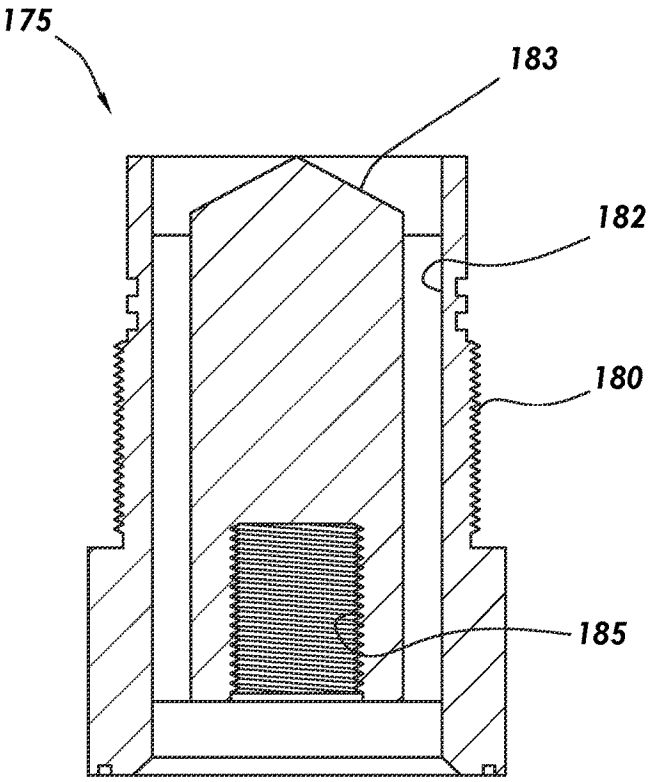
FIG. 7 depicts a cross section view of a one-piece severing head of a circular cutting torch consistent with at least one embodiment of the present disclosure.

FIGS. 7, 7A, 7B depict one-piece severing head 175 consistent with at least one embodiment of the present disclosure. In some embodiments, one-piece severing head 175 may include outer coupler 180 positioned to mechanically couple to lower coupler 179 of top sub 173. One-piece severing head 175 may include one or more holes 182 formed longitudinally through one-piece severing head 175. In some embodiments, one-piece severing head 175 may include center cone 183. Center cone 183 may serve to direct molten combustible material from compressed grain magazine 151 into holes 182 during activation of circular cutting torch 100 as the molten combustible material enters one-piece severing head 175 from top sub 173. In some embodiments, one-piece severing head 175 may include inner coupler 185 positioned to couple to anchor base 201 as shown in FIG. 1. In some embodiments, one-piece severing head 175 may be formed from a material capable of withstanding high temperatures and pressures. In some embodiments, one-piece severing head 175 may be formed from a refractory material such as, for example and without limitation, tungsten, molybdenum, niobium, tantalum, rhenium, and alloys thereof.

In some embodiments, with reference to FIG. 1, severing head assembly 171 may include progressive compression deflector 187. Progressive compression deflector 187 may be coupled to one-piece severing head 175 by anchor base 201 such that molten combustible material may engage progressive compression deflector 187 after passing through holes 182 of one-piece severing head 175. In some embodiments, one progressive compression deflector 187 may be formed from a material capable of withstanding high temperatures and pressures. In some embodiments, progressive compression deflector 187 may be formed from a refractory material such as, for example and without limitation, tungsten, molybdenum, niobium, tantalum, rhenium, and alloys thereof.

Figure 8:
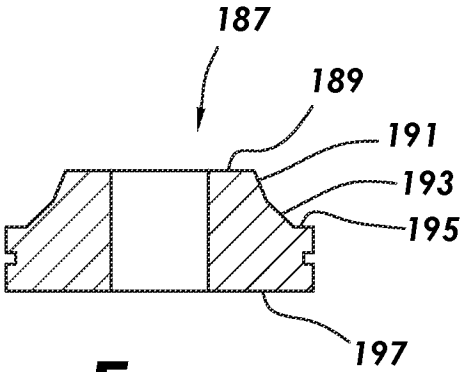
FIG. 8 depicts a cross section view of a progressive compression deflector of a circular cutting torch consistent with at least one embodiment of the present disclosure.
Figure 8A:
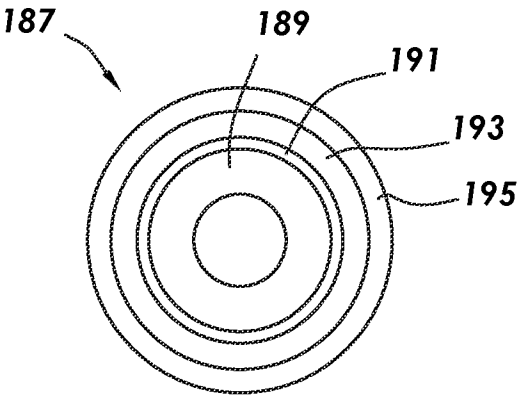
FIG. 8A depicts a top view of the progressive compression deflector of FIG. 8.

As shown in FIGS. 8, 8A, progressive compression deflector 187 may include upper engagement surface 189 configured to abut one-piece severing head 175. In some embodiments, upper engagement surface 189 may have a diameter selected such that upper engagement surface is radially within holes 182 of one-piece severing head 175 such that upper engagement surface 189 does not obstruct holes 182.

In some embodiments, progressive compression deflector 187 may redirect molten combustible material as it passes between one-piece severing head 175 and progressive compression deflector 187 from a substantially longitudinal direction of propagation to a substantially radial direction of propagation. In some embodiments, progressive compression deflector 187 may include one or more frustoconical faces positioned to progressively redirect and compress the molten combustible material. For example, progressive compression deflector 187 may include first stage face 191 and second stage face 193. In some embodiments, progressive compression deflector 187 may further include third stage face 195. In such embodiments, third stage face 195 may extend substantially parallel to the desired direction of propagation for molten combustible material to exit circular cutting torch 100, thus defining the cutting plane of circular cutting torch 100. In some embodiments, for example and without limitation, third stage face 195 may be substantially perpendicular to the longitudinal axis of circular cutting torch 100. In other embodiments, as discussed further below, third stage face 195 may extend at an angle other than perpendicular to the longitudinal axis of circular cutting torch 100.

In some embodiments, because first stage face 191 and second stage face 193 are frustoconical, the cross-sectional area between progressive compression deflector 187 and one-piece severing head 175 decreases along progressive compression deflector 187. In some embodiments, first stage face 191 may be formed at a steeper angle relative to third stage face 195 than second stage face 193. In such an embodiment, as molten combustible material flows between progressive compression deflector 187 and one-piece severing head 175, the molten combustible material first engages first stage face 191 and experiences compression at a first rate, defined herein as first stage compression, defined at least in part by the angle of first stage face 191. Once the molten combustible material engages second stage face 193, the molten combustible material experiences compression at a second rate, defined herein as second stage compression, defined at least in part by the angle of second stage face 193. Because first stage face 191 is formed at a steeper angle than second stage face 193, the first stage compression occurs at a lower rate than the second stage compression. Additionally, because second stage face 193 is at a shallower angle relative to third stage face 195, the redirection of molten combustible material occurs over a longer distance thereby, without being bound to theory, resulting in smoother flow and compression thereof as the molten combustible material engages third stage face 195 before exiting circular cutting torch 100 and cutting the pipe or casing circular cutting torch 100 is positioned within. In some embodiments, for example and without limitation, first stage face 191 may be formed at an angle between 60° and 85° measured relative to third stage face 195, and second stage face 193 may be formed at an angle between 35° and 55° measured relative to third stage face 195.

In some embodiments, progressive compression deflector 187 may be positioned such that third stage face 195 is spaced apart from one-piece severing head 175, defining radial gap 188.

Figure 9:
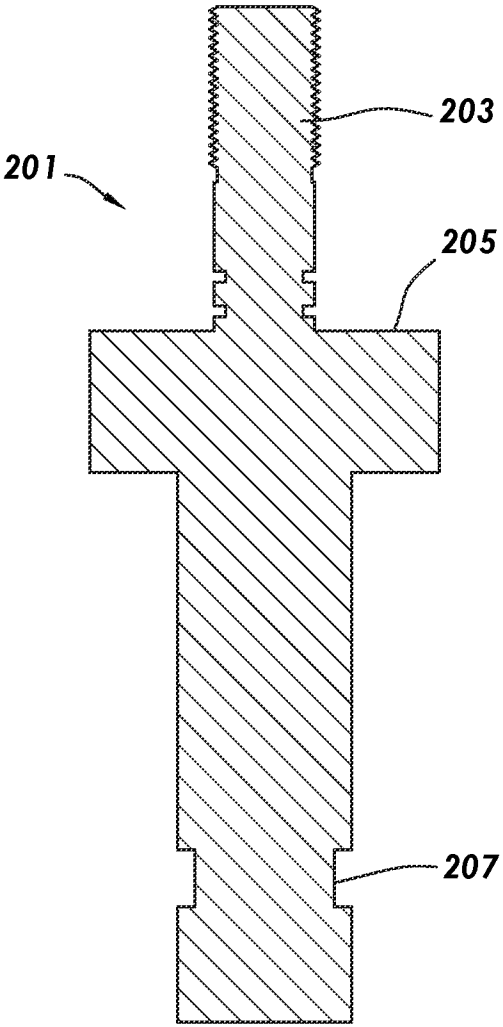
FIG. 9 depicts a cross section view of an anchor base of a circular cutting torch consistent with at least one embodiment of the present disclosure.

Progressive compression deflector 187 may include lower surface 197. Lower surface 197 may abut anchor base 201 such that progressive compression deflector 187 is held in place relative to one-piece severing head 175 as shown in FIG. 1. As shown in FIG. 9, anchor base 201 may include upper stem 203 positioned to extend through progressive compression deflector 187 and engage to inner coupler 185.

In some embodiments, anchor base 201 may include upper flange 205 positioned to abut against progressive compression deflector 187 to retain progressive compression deflector 187 to one-piece severing head 175. In some embodiments, anchor base 201 may include lower coupler 207 positioned to allow additional equipment to couple to circular cutting torch 100. For example and without limitation, lower coupler 207 may be used to couple an anchoring system or stabilizer.

With reference to FIG. 1, in some embodiments, circular cutting torch 100 may include one or more backpressure generating features 211 positioned to retard the release of high-pressure molten combustible material from within one-piece severing head 175 until the pressure is at or above a desired threshold level. In some embodiments, backpressure generating features 211 may include one or more of pressure discs or burst discs as further discussed below.

Figure 10:
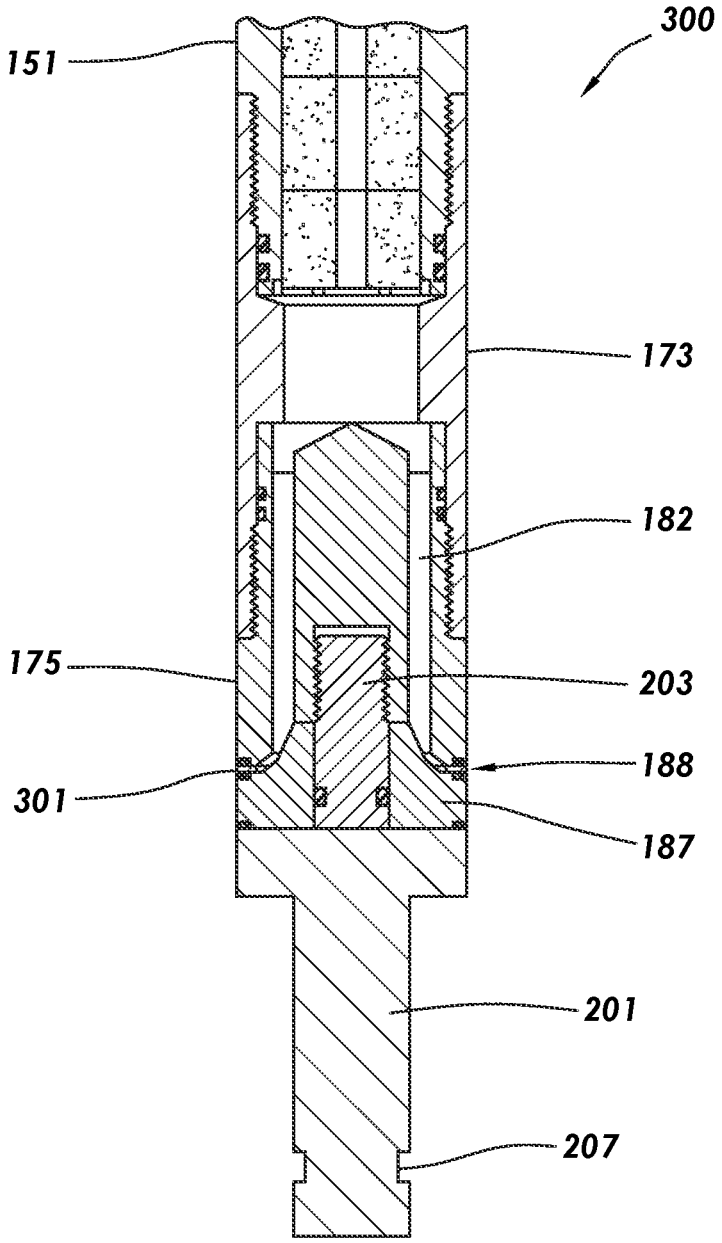
FIG. 10 depicts a detail cross section view of a circular cutting torch consistent with at least one embodiment of the present disclosure.
Figure 10A:
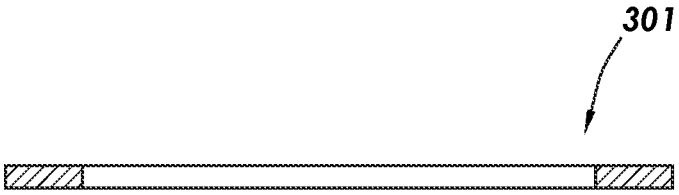
FIG. 10A depicts a cross section view of a standalone pressure disc consistent with at least one embodiment of the present disclosure.

For example, circular cutting torch 300, as shown in FIG. 10, may include standalone pressure disc 301 positioned between progressive compression deflector 187 and one-piece severing head 175. Standalone pressure disc 301, also shown in FIG. 10A, may be annular in shape and may be positioned to fill radial gap 188 formed between progressive compression deflector 187 and one-piece severing head 175. In such embodiments, standalone pressure disc 301 may be formed from a material and may have a geometry selected such that standalone pressure disc 301 remains in place and intact until the pressure within one-piece severing head 175 is above a selected threshold pressure, at which time standalone pressure disc 301 fails mechanically and is expelled from radial gap 188 between progressive compression deflector 187 and one-piece severing head 175, thereby allowing the high pressure molten combustible material to exit circular cutting torch 300 and cut the tube or casing within which circular cutting torch 300 is positioned.

Figure 11:
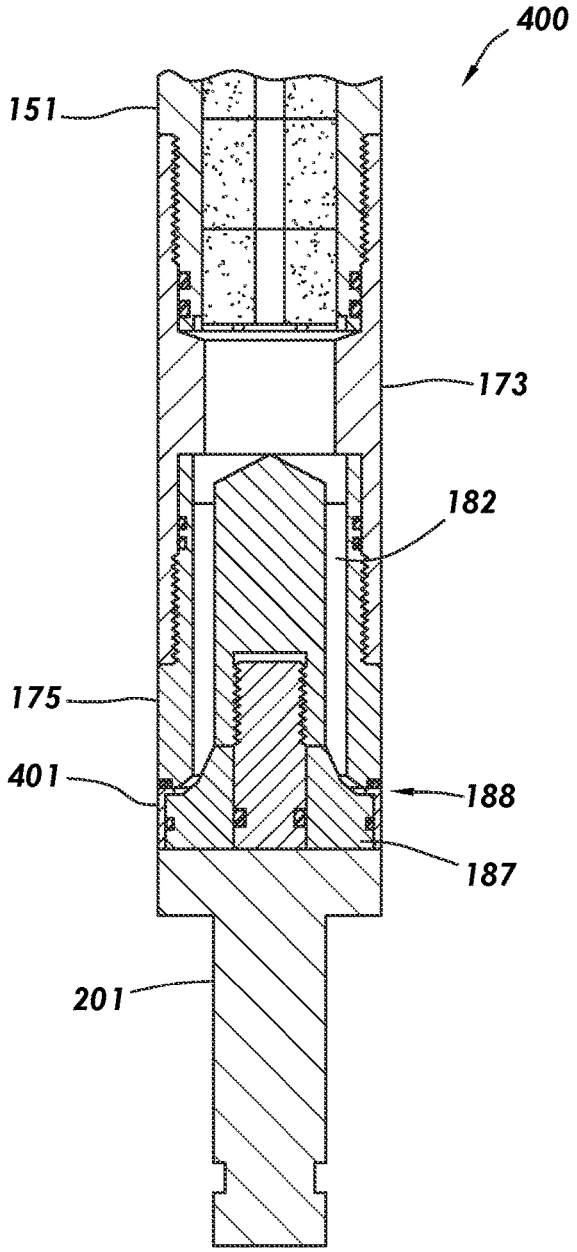
FIG. 11 depicts a detail cross section view of a circular cutting torch consistent with at least one embodiment of the present disclosure.
Figure 11A:
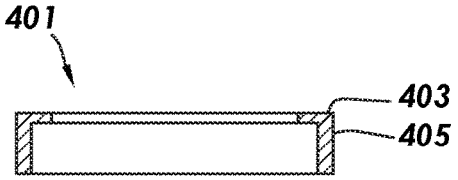
FIG. 11A depicts a cross section view of a radially supported pressure disc consistent with at least one embodiment of the present disclosure.
Figure 11B:
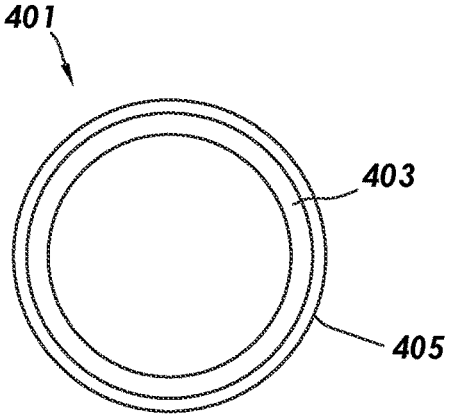
FIG. 11B depicts a bottom view of the radially supported pressure disc of FIG. 11A.

In other embodiments, circular cutting torch 400, as shown in FIG. 11, may include radially supported pressure disc 401. Radially supported pressure disc 401, also shown in FIGS. 11A, 11B, may include pressure disc 403 and support lip 405. Pressure disc 403 may substantially be positioned to fill radial gap 188 formed between progressive compression deflector 187 and one-piece severing head 175 and may operate as described herein above with respect to standalone pressure disc 301. Support lip 405 may, in some embodiments, extend about the outer surface of progressive compression deflector 187 and may, for example and without limitation, assist with centering and retaining radially supported pressure disc 401 as well as increasing sealing between radially supported pressure disc 401 and progressive compression deflector 187. During activation of circular cutting torch 400, as pressure disc 403 is ruptured and expelled, all or part of support lip 405 may also be expelled from circular cutting torch 400.

Figure 12:
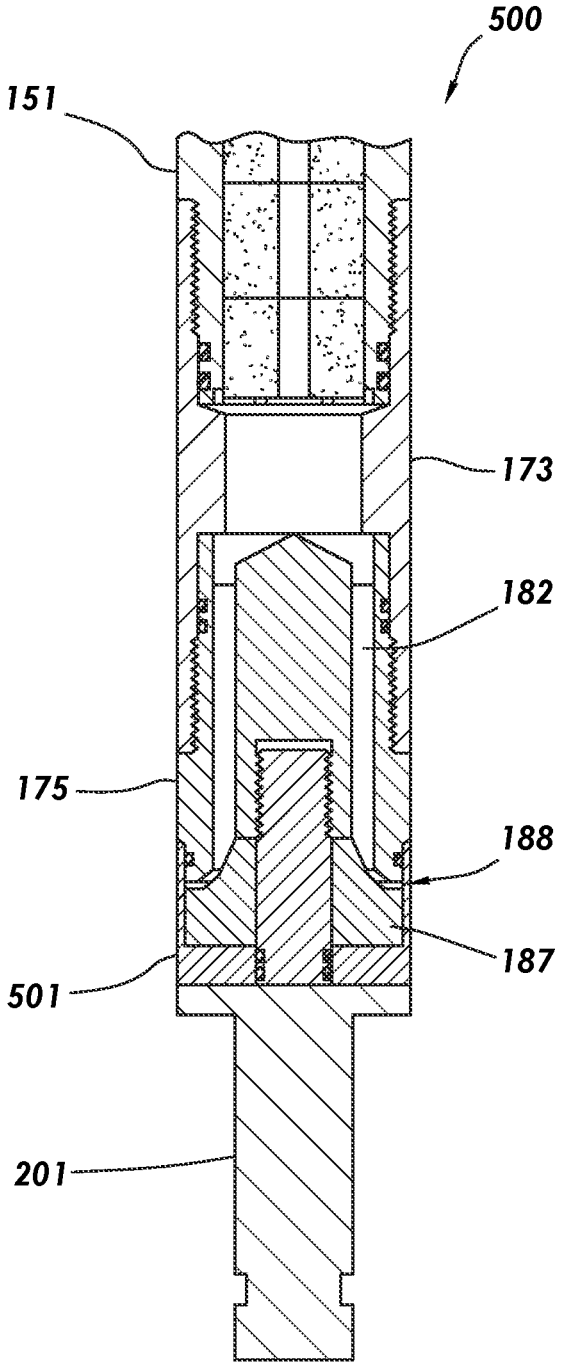
FIG. 12 depicts a detail cross section view of a circular cutting torch consistent with at least one embodiment of the present disclosure.
Figure 12A:
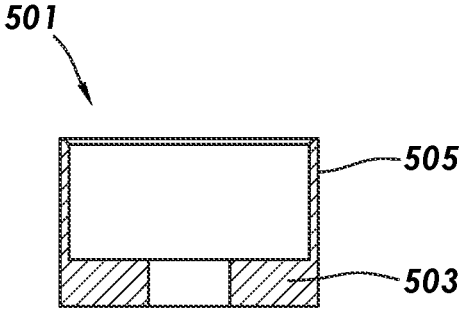
FIG. 12A depicts a cross section view of a laterally supported pressure housing consistent with at least one embodiment of the present disclosure.

In other embodiments, circular cutting torch 500, as shown in FIG. 12, may include laterally supported pressure housing 501. Laterally supported pressure housing 501, also shown in FIG. 12A, may include base 503 and pressure sleeve 505. Base 503 may be positioned between progressive compression deflector 187 and anchor base 201 and may be adapted to allow upper stem 203 to pass therethrough such that the coupling of anchor base 201 to one-piece severing head 175 may retain laterally supported pressure housing 501 in place. Pressure sleeve 505 may extend about progressive compression deflector 187 and at least partially about one-piece severing head 175 such that pressure sleeve 505 covers the gap between progressive compression deflector 187 and one-piece severing head 175. In such embodiments, pressure sleeve 505 may be formed from a material and may have a geometry selected such that pressure sleeve 505 remains in place and intact until the pressure within one-piece severing head 175 is above a selected threshold pressure, at which time pressure sleeve 505 fails mechanically, opening radial gap 188 between progressive compression deflector 187 and one-piece severing head 175, thereby allowing the high pressure molten combustible material to exit circular cutting torch 500 and cut the tube or casing within which circular cutting torch 500 is positioned.

Figure 13:
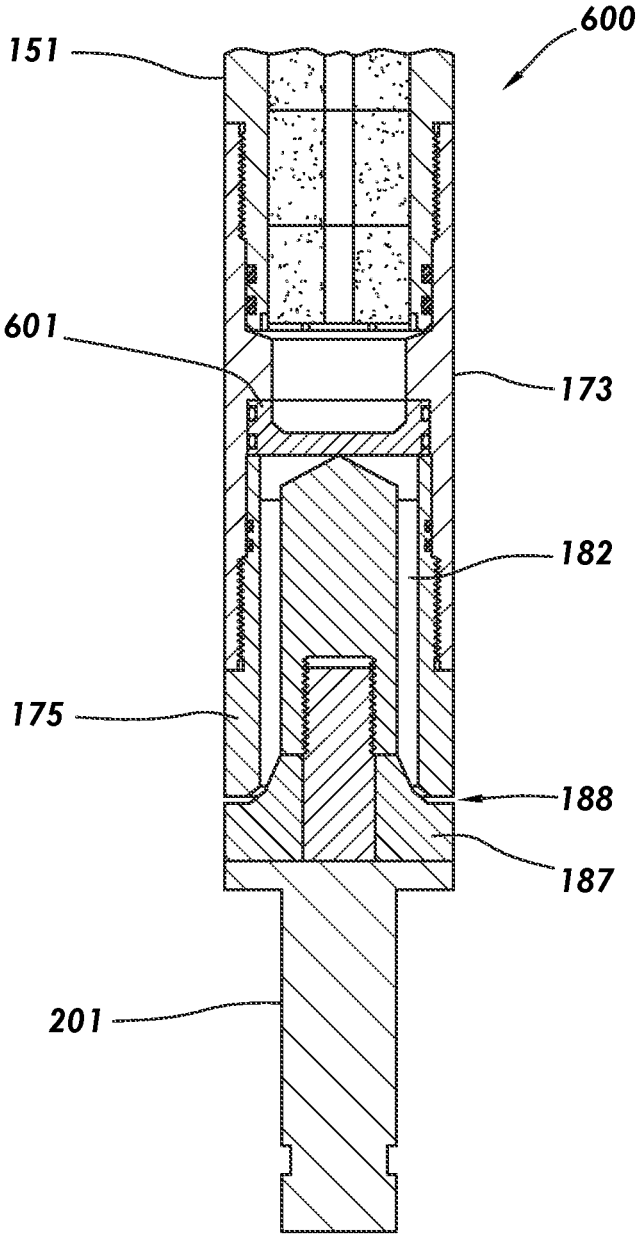
FIG. 13 depicts a detail cross section view of a circular cutting torch consistent with at least one embodiment of the present disclosure.
Figure 13A:
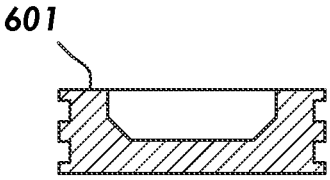
FIG. 13A depicts a cross section view of a rupture disc consistent with at least one embodiment of the present disclosure.

In some embodiments, circular cutting torch 600, as shown in FIG. 13, may include rupture disc 601. Rupture disc 601 may be positioned within the interior of circular cutting torch 600 between compressed grain magazine 151 and one-piece severing head 175. When intact, rupture disc 601 may fluidly separate the interior of circular cutting torch 600 that includes compressed grain magazine 151 from the interior of one-piece severing head 175. Rupture disc 601, also shown in FIG. 13A, may be formed from a material and may have a geometry selected such that rupture disc 601 remains intact until the pressure within compressed grain magazine 151 is above a selected threshold pressure, at which time rupture disc 601 fails mechanically, opening the flow path for molten combustible material to enter and traverse one-piece severing head 175, contact progressive compression deflector 187, and exit radial gap 188 between progressive compression deflector 187 and one-piece severing head 175, thereby allowing the high pressure molten combustible material to exit circular cutting torch 600 and cut the tube or casing within which circular cutting torch 600 is positioned.

In such an embodiment, because radial gap 188 between progressive compression deflector 187 and one-piece severing head 175 is not obstructed, the resultant jet of molten combustible material exiting through radial gap 188 may, for example and without limitation, be more uniform than an embodiment in which a pressure disc is used. In other embodiments, rupture disc 601 may be used in conjunction with a standalone pressure disc, radially supported pressure disc, or laterally supported pressure housing as discussed herein above.

Additionally, in some such embodiments, wellbore fluid may enter one-piece severing head 175 through radial gap 188. In such an embodiment, upon activation of circular cutting torch 600, wellbore fluid within one-piece severing head may be expelled from one-piece severing head 175. As the molten combustible material enters one-piece severing head 175 after breaking through rupture disc 601, the molten combustible material forces the wellbore fluid within one-piece severing head 175 to be expelled through radial gap 188. This expulsion may, without being bound to theory, reduce shock energy experienced by circular cutting torch 600 when activated and may allow for a more even filling of one-piece severing head 175 and thereby to a cleaner radial cut.

In some embodiments, with reference to FIG. 1, the geometry of progressive compression deflector 187 may be selected such that the jet of molten combustible material may extend radially away from circular cutting torch 100 in a substantially planar direction. Specifically, such embodiments include progressive compression deflector 187 having third stage face 195 that is formed substantially perpendicular to the longitudinal axis of circular cutting torch 100.

Figure 14:
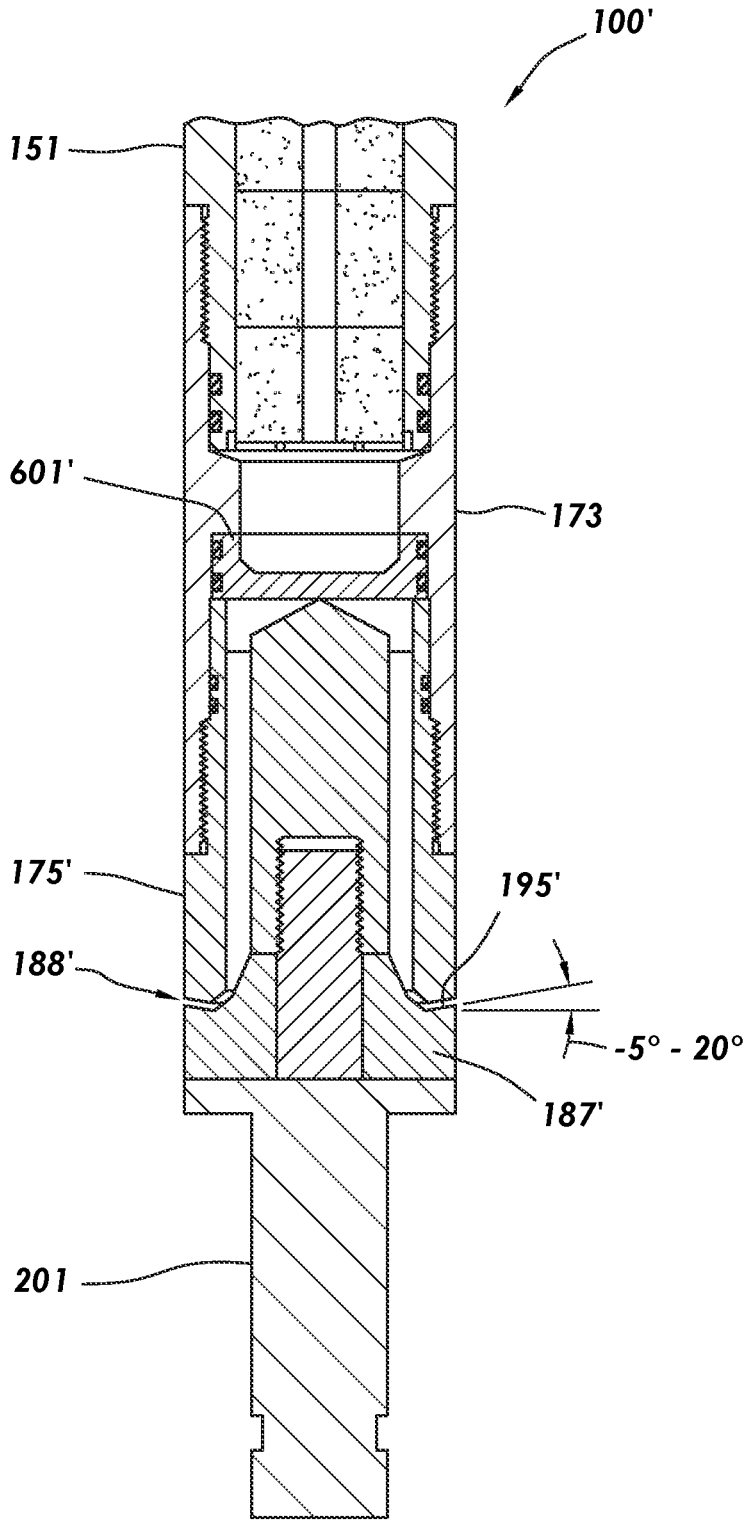
FIG. 14 depicts a detail cross section view of a circular cutting torch consistent with at least one embodiment of the present disclosure

In other embodiments, such as shown in FIG. 14, third stage face 195' of progressive compression deflector 187' of circular cutting torch 100' may be frustoconical such that the jet of molten combustible material is directed radially from circular cutting torch 100' but at an angle other than perpendicular to the longitudinal axis of circular cutting torch 100'. For example and without limitation, third stage face 195' of progressive compression deflector 187' may angle upward in a radially outward direction. In such an embodiment, the jet of molten combustible material is directed radially from circular cutting torch 100' and in an upward direction. In some such embodiments, for example and without limitation, third stage face 195' may be formed at an angle of between 5° and 20°. In some such embodiments, the force on circular cutting torch 100' caused by the redirection of the jet to an upward direction may generate a resultant downward force on circular cutting torch 100'. Such a force may, for example and without limitation, pull against the wireline, slickline, tubing, or tubular string to which circular cutting torch 100' is coupled. Such a force may, for example and without limitation, thereby obviate the need to otherwise anchor circular cutting torch 100' in place within the wellbore or perforate the tubing or casing before activating circular cutting torch 100'. In some such embodiments, one-piece severing head 175' may be formed with a corresponding angle to further allow the jet to progress in the desired direction.

In embodiments where circular cutting torch 100' includes rupture disc 601', because radial gap 188' between progressive compression deflector 187' and one-piece severing head 175' is not obstructed, the resultant jet of molten combustible material exiting through radial gap 188' may, for example and without limitation, be more uniform than an embodiment in which a pressure disc is used. In other embodiments, rupture disc 601' may be used in conjunction with a standalone pressure disc, radially supported pressure disc, or laterally supported pressure housing as discussed herein above.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A circular cutting torch comprising:

a thermal igniter assembly;

a compressed grain magazine, the compressed grain magazine coupled to the thermal igniter; and a severing head assembly, the severing head assembly including a one-piece severing head and a progressive compression deflector, the one-piece severing head and progressive compression deflector defining a radial gap therebetween, the progressive compression deflector including a first stage face, a second stage face, and a third stage face, wherein the first stage face and second stage face are frustoconical.

2. The circular cutting torch of claim 1, wherein the third stage face is substantially planar and is arranged perpendicular to a longitudinal axis of the circular cutting torch.

3. The circular cutting torch of claim 1, wherein the third stage face is substantially frustoconical and is arranged at an angle to a plane extending perpendicularly to a longitudinal axis of the circular cutting torch.

4. The circular cutting torch of claim 3, wherein the third stage face is angled upward such that activation of the circular cutting torch anchors the circular cutting torch in position within a wellbore.

5. The circular cutting torch of claim 1, wherein the one-piece severing head comprises a center cone at an upper end thereof.

6. The circular cutting torch of claim 1, wherein the one-piece severing head comprises one or more holes extending substantially longitudinally through the one-piece severing head.

7. The circular cutting torch of claim 1, wherein the compressed grain magazine comprises a magazine housing and a compressed nonexplosive combustible material positioned therein.

8. The circular cutting torch of claim 7, wherein the compressed nonexplosive combustible material is thermite.

9. The circular cutting torch of claim 1, wherein the thermal igniter assembly comprises a cartridge containment sub, a thermal igniter, and a thermal cartridge.

10. The circular cutting torch of claim 9, wherein the thermal cartridge comprises a cartridge housing and a nonexplosive combustible material positioned therein.

11. The circular cutting torch of claim 10, wherein the nonexplosive combustible material is loose powdered thermite.

12. The circular cutting torch of claim 10, wherein the cartridge housing includes an outer housing, a top cap, and a bottom cap, wherein the top cap includes at least one center hole formed therein and the bottom cap includes at least one hole formed therein.

13. The circular cutting torch of claim 9, wherein the thermal igniter comprises a heating coil assembly.

14. The circular cutting torch of claim 1, wherein the thermal igniter assembly comprises an electrical sub.

15. The circular cutting torch of claim 1, further comprising a laterally supported pressure housing, the laterally supported pressure housing including a base positioned below the progressive compression deflector and a pressure sleeve positioned about the radial gap.

16. The circular cutting torch of claim 1, wherein the one-piece severing head and the progressive compression deflector are formed from a refractory material.

17. A circular cutting torch comprising:

a thermal igniter assembly;

a compressed grain magazine, the compressed grain magazine coupled to the thermal igniter;

a severing head assembly, the severing head assembly including a one-piece severing head and a progressive compression deflector, the one-piece severing head and progressive compression deflector defining a radial gap therebetween; and a standalone pressure disc positioned in the radial gap between the one-piece severing head and the progressive compression deflector.

18. A circular cutting torch comprising:

a thermal igniter assembly;

a compressed grain magazine, the compressed grain magazine coupled to the thermal igniter;

a severing head assembly, the severing head assembly including a one-piece severing head and a progressive compression deflector, the one-piece severing head and progressive compression deflector defining a radial gap therebetween; and a radially supported pressure disc, the radially supported pressure disc including a support lip positioned radially about the outer surface of the progressive compression deflector and a pressure disc positioned in the radial gap between the one-piece severing head and the progressive compression deflector.

19. A circular cutting torch comprising:

a thermal igniter assembly;

a compressed grain magazine, the compressed grain magazine coupled to the thermal igniter;

a severing head assembly, the severing head assembly including a one-piece severing head and a progressive compression deflector, the one-piece severing head and progressive compression deflector defining a radial gap therebetween; and a rupture disc positioned between the compressed grain magazine and the one-piece severing head, the rupture disc adapted to fail mechanically once the circular cutting torch is activated.

20. The circular cutting torch of claim 19, wherein the one-piece severing head is filled with wellbore fluid while the rupture disc is intact.

21. A method comprising:

positioning a circular cutting torch in a casing or tubular desired to severed, the circular cutting torch including:

a thermal igniter assembly, the thermal igniter assembly including a cartridge containment sub, a thermal igniter, and a thermal cartridge, the thermal cartridge including a cartridge housing and a nonexplosive combustible material positioned therein;

a compressed grain magazine, the compressed grain magazine coupled to the thermal igniter, the compressed grain magazine including a magazine housing and a compressed nonexplosive combustible material positioned therein;

a severing head assembly coupled to the compressed grain magazine, the severing head assembly including a one-piece severing head and a progressive compression deflector, the one-piece severing head and progressive compression deflector defining a radial gap therebetween; and a rupture disc positioned between the compressed grain magazine and the severing head assembly activating the thermal igniter;

igniting the nonexplosive combustible material of the thermal cartridge;

igniting the compressed nonexplosive combustible material of the compressed grain magazine with exhaust gases and molten combustible material of the nonexplosive combustible material of the thermal cartridge;

building pressure within the compressed grain magazine;

rupturing the rupture disc;

expelling exhaust gases and molten combustible material of the compressed nonexplosive combustible material of the compressed grain magazine through the radial gap of the severing head assembly; and cutting the casing or tubular using the exhaust gases and molten combustible material expelled through the radial gap.

22. The method of claim 21, further comprising allowing wellbore fluid from the casing or tubular to enter the severing head assembly through the radial gap prior to the rupturing of the rupture disc.

23. The method of claim 22, further comprising ejecting the wellbore fluid from the severing head assembly with the exhaust gases and molten combustible material of the nonexplosive combustible material of the thermal cartridge.

24. A method comprising:

positioning a circular cutting torch in a casing or tubular desired to severed, the circular cutting torch including:

a thermal igniter assembly, the thermal igniter assembly including a cartridge containment sub, a thermal igniter, and a thermal cartridge, the thermal cartridge including a cartridge housing and a nonexplosive combustible material positioned therein;

a compressed grain magazine, the compressed grain magazine coupled to the thermal igniter, the compressed grain magazine including a magazine housing and a compressed nonexplosive combustible material positioned therein; and a severing head assembly coupled to the compressed grain magazine, the severing head assembly including a one-piece severing head and a progressive compression deflector, the one-piece severing head and progressive compression deflector defining a radial gap therebetween wherein the radial gap is angled upward toward the top of the circular cutting torch;

activating the thermal igniter;

igniting the nonexplosive combustible material of the thermal cartridge;

igniting the compressed nonexplosive combustible material of the compressed grain magazine with exhaust gases and molten combustible material of the nonexplosive combustible material of the thermal cartridge;

expelling exhaust gases and molten combustible material of the compressed nonexplosive combustible material of the compressed grain magazine through the radial gap of the severing head assembly;

cutting the casing or tubular using the exhaust gases and molten combustible material expelled through the radial gap; and anchoring the circular cutting torch within the tubular or casing by a resultant downward force caused by the upward expulsion of the exhaust gases and molten combustible material through the angled radial gap.

25. The method of claim 24, wherein the casing or tubular is not perforated prior to cutting the casing or tubular.

26. A circular cutting torch comprising:

a thermal igniter assembly;

a compressed grain magazine, the compressed grain magazine coupled to the thermal igniter, the compressed grain magazine including a magazine housing and a compressed nonexplosive combustible material positioned therein, the compressed grain magazine including a compression disc positioned at each end of the magazine housing, wherein each compression disc includes one or more compression disc holes formed therein; and a severing head assembly, the severing head assembly including a one-piece severing head and a progressive compression deflector, the one-piece severing head and progressive compression deflector defining a radial gap therebetween.

* * * * *